United States Patent [19]

Labbe et al.

[11] Patent Number: 4,459,998

[45] Date of Patent: Jul. 17, 1984

[54] MANUFACTURE OF CIGARETTES

[75] Inventors: Francis A. M. Labbe, Neuilly-sur-Seine, France; John R. Nowers, London, England

[73] Assignee: Molins Limited, London, England

[21] Appl. No.: 235,601

[22] Filed: Feb. 18, 1981

[30] Foreign Application Priority Data

Feb. 20, 1980 [GB] United Kingdom ..... 8005760

[51] Int. Cl.[3] ..... A24C 5/14

[52] U.S. Cl. ..... 131/62; 131/31; 131/84 R; 131/364

[58] Field of Search ..... 131/280, 32, 33, 31, 131/34, 35, 58, 60, 62, 65, 67, 84 R, 84 C, 364

[56] References Cited

U.S. PATENT DOCUMENTS 579,421 3/1897 Campbell ..... 131/360
725,671 4/1903 Butler ..... 131/360
3,524,454 8/1970 Sexstone ..... 131/84 R
3,744,496 7/1973 McCarty et al. ..... 131/358
4,168,712 9/1979 Labbe ..... 131/84 R

FOREIGN PATENT DOCUMENTS 2254063 5/1973 Fed. Rep. of Germany ..... 131/31

*Primary Examiner*—Vincent Millin
*Attorney, Agent, or Firm*—Antonelli, Terry & Wands

[57] ABSTRACT

Cigarettes are made by forming a basic filler stream comprising particles of tobacco or artificial tobacco or a combination of both, folding around the basic filler stream a web of reconstituted tobacco, and enclosing the resulting combination in a continuous paper wrapper to form a continuous cigarette rod which is then cut into predetermined lengths.

The web may be continuous or may be in an expanded form as described in British Patent Specification No. 1531463.

7 Claims, 2 Drawing Figures

MANUFACTURE OF CIGARETTES

According to this invention, cigarettes are made by forming a basic filler stream comprising particles of tobacco or artificial tobacco or a combination of both, folding around the basic filler stream a web of reconstituted tobacco, and enclosing the resulting combination in a continuous paper wrapper to form a continuous cigarette rod which is then cut into predetermined lengths.

The web of reconstituted tobacco may be applied in a continuous form. For example, in a cigarette of approximately 8 mm diameter, it may have a thickness within the range 0.25 to 1.5 mm.

Alternatively, the web of reconstituted tobacco may be expanded in the manner described in our British patent specification No. 1531463. That is to say, a web may be formed with transversely-extending rows of staggered slits after which it can be expanded by being stretched longitudinally while it is fed to the position at which it is folded around the basic filler stream. As mentioned in the patent specification, the pitch between rows of slits may be smaller in the region where the finished rod is cut to form individual cigarettes.

Much of the cigarette flavour may lie in the reconstituted tobacco web. For example, different brands of cigarettes may be made by using a common basic filler stream of substantially neutral flavor, and the different taste and other characteristics (e.g. in regard to nicotine content) may be imparted to the different brands of cigarettes by way of additives contained in the reconstituted tobacco web. In this way, a given cigarette making machine can be used to make different brands of cigarettes during different periods merely by using appropriate reels of reconstituted tobacco web, the basic filler stream for each brand being formed from the same material.

In the accompanying drawings.

Figure 1:
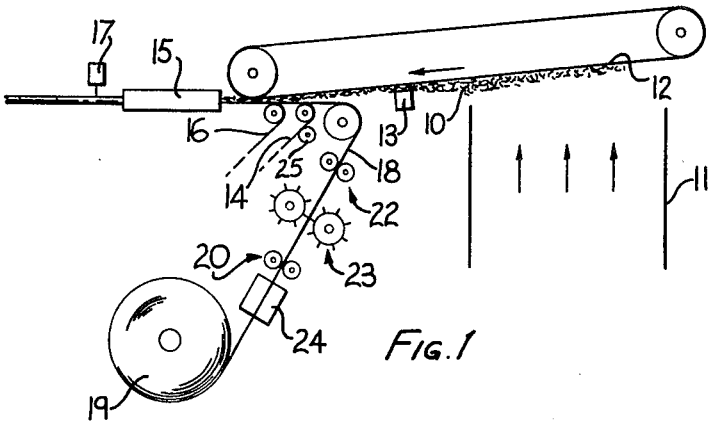
FIG. 1 is a diagrammatic view of a cigarette making machine according to this invention, arranged to apply an expanded web of reconstituted tobacco.

The machine shown in FIG. 1 is basically like a Molins Mark 8 or Mark 9 cigarette making machine in that a basic filler stream 10 is formed by showering particles of tobacco and/or other filler material up a chimney 11 with the aid of an upwardly moving air stream. At the top of the chimney there is a suction band 12 underneath which the filler stream is formed so as to be carried forward by the suction band. After passing a trimmer 13, the filler stream is deposited on a paper wrapper 14 which is carried through a rod forming unit 15 by a garniture tape 16. In the unit 15, the wrapper is secured around the filler to form a continuous cigarette rod which is then cut at regular intervals by a cutting device 17.

Before the paper wrapper is wrapped around the basic filler stream, an expanded web of reconstituted tobacco 18 is fed on to the wrapper 14. The web 18 is drawn from a reel 19 and is conveyed by two pairs of feed rollers 20 and 22 past a pair of slitting rollers 23. After leaving the feed rollers 22, the web 18 is fed at a greater speed so as to be expanded in the manner described in the above-mentioned patent specification.

Additives, for example flavoring ingredients, may be sprayed or otherwise applied to the web 18 in a chamber 24. Alternatively such additives may be incorporated in the reconstituted tobacco web during the manufacture thereof or subsequently but before it is wound onto the reel 19.

It will be appreciated that the width of the web 18 is approximately equal to the circumference of the finished cigarette rod.

Figure 2:
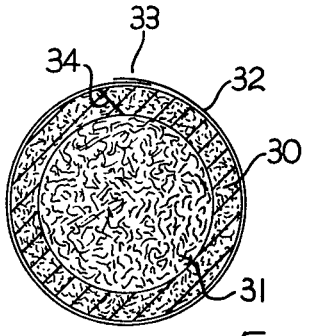
FIG. 2 is a cross-section through a finished cigarette having a continuous (non-expanded) reconstituted tobacco web.

FIG. 2 is a cross-section of a cigarette according to this invention including a continuous web of reconstituted tobacco 30 surrounding a basic filler 31. The cigarette is completed by a paper wrapper 32 of which the edges are overlapped and joined by adhesive to form a longitudinal seam at 33. Abutting edges 34 of the web 30 are chamfered so as to be inclined to a radial line at that position.

In this example the outer diameter of the cigarette is 8 mm and the web 30 is approximately 1 mm thick. Alternatively the web 30 may be far thinner; for example, it may be approximately as thin or nearly as thin as the paper wrapper.

Other details of the machine and of the method of manufacture of the cigarettes may be in accordance with the Molins Mark 8 or Mark 9 cigarette making machine.

When using either a continuous or expanded web of reconstituted tobacco, adhesive may be applied along the middle of the paper wrapper by applicator means 25 to locate the reconstituted tobacco web laterally on the wrapper as they enter the unit 15. Such adhesive may constitute the means or part of the means of entraining and carrying forward the leading end of the web on a new reel when the previous reel is exhausted. For example, the web may be arranged to run in contact with the wrapper for a substantial distance, starting upstream of a web "splicing" device; when a reel is about to be exhausted, the new reel may be accelerated so that the leading end or a leading portion of the web on it can be stuck to the wrapper when the trailing end of the previous web reaches the "splicing" device. Additional adhesive may be applied to the wrapper or to the leading end of the new web to ensure that there is adequate adhesion.

In order to avoid a need for frequent splicing of the web, the web may be wound helically on its reel or bobbin so that each reel or bobbin can contain a large volume of web; the reel or bobbin should in this case (and preferably in any event) be positively driven so as to avoid putting the web under any significant degree of tension. Alternatively the web may, instead of being wound, be packed in zig-zag fashion in several stacks in a container from which it is pulled continuously through an opening at the top of the container.

A continuous web may be formed by extruding foamed reconstituted tobacco. Foaming may be caused or assisted by the introduction of particles of insoluble flavoring material into the reconstituted tobacco slurry before it is extruded.

We claim:

1. A method of making cigarettes in which a basic filler stream is formed from particles of tobacco or artificial tobacco or from a combination of both materials, a web of reconstituted tobacco and a continuous paper wrapper are each folded around the filler stream, with the paper wrapper on the outside to form a continuous cigarette rod which is then cut into individual rods of predetermined length, where the filler stream is deposited on the web after the web is fed onto the paper wrapper, and in which adhesive is applied along the web or wrapper to cause the web to adhere to the wrapper before they are both applied to the filler stream.

2. A cigarette making machine comprising means for forming a basic filler stream from particles of tobacco and/or other particulate material, and means for folding a web of reconstituted tobacco and a continuous paper wrapper around the filler stream to form a continuous rod in which the web of reconstituted tobacco surrounds the basic filler stream and is itself surrounded by the paper wrapper, characterized in that the filler stream is arranged to be deposited on the web after the web is fed onto the paper wrapper, including means for applying adhesive along the web or wrapper before they are both applied to the filler stream.

3. A method of making cigarettes in which a basic filler stream is formed from particles of tobacco or artificial tobacco or from a combination of both materials, a web of reconstituted tobacco and a continuous paper web are each folded around the filler stream, with the paper wrapper on the outside, to form a continuous cigarette rod which is then cut into individual rods of predetermined length, wherein the web of reconstituted tobacco, before being folded around the filler stream, is formed with transversely extending rows of staggered slits and is expanded by being longitudinally stretched.

4. A method according to claim 3 in which the basic filler stream is made from material which is of substantially neutral flavor, and in which flavoring is contained in or applied to the web of reconstituted tobacco.

5. A cigarette making machine comprising means for forming a basic filler stream from particles of tobacco and/or other particulate material, and means for folding a web of reconstituted tobacco and a continuous paper wrapper around the filler stream to form a continuous rod in which the web of reconstituted tobacco surrounds the basic filler stream and is itself surrounded by the paper wrapper, characterized in that the web, before being folded around the filler stream, is formed with transversely extending rows of staggered slits and is expanded by being longitudinally stretched.

6. A cigarette comprising a filler consisting of particles of tobacco or artificial tobacco or a combination of both materials surrounded by a web of reconstituted tobacco which is in turn surrounded by a paper wrapper having overlapping longitudinal edges which are secured to one another, in which the web is formed with transversely extending rows of staggered slits and is in a longitudinally expanded condition.

7. A cigarette according to claim 6 in which the web is secured to the wrapper by adhesive at various positions along the cigarette.

* * * * *